US006619028B2

(12) United States Patent
Kreiner et al.

(10) Patent No.: US 6,619,028 B2
(45) Date of Patent: Sep. 16, 2003

(54) ELECTRIC THRUSTER MADE WITH SURFACE TREATMENTS FOR IMPROVED THERMAL MANAGEMENT

(75) Inventors: Kurt B. Kreiner, Verdes, CA (US); John R. Beattie, Westlake Village, CA (US)

(73) Assignee: The Boeing Co., Seattle, WA (US)

( * ) Notice: Subject to any disclaimer, the term of this patent is extended or adjusted under 35 U.S.C. 154(b) by 73 days.

(21) Appl. No.: 10/011,159

(22) Filed: Dec. 5, 2001

(65) Prior Publication Data

US 2003/0136106 A1 Jul. 24, 2003

(51) Int. Cl.[7] ..... H05H 1/00
(52) U.S. Cl. ..... 60/202; 60/203.1
(58) Field of Search ..... 60/202, 204, 203.1; 313/44, 45, 362.1, 231.1

(56) References Cited

U.S. PATENT DOCUMENTS 3,620,018 A * 11/1971 Banks ..... 60/202
4,937,456 A * 6/1990 Grim et al. ..... 250/427
5,924,277 A * 7/1999 Beattie et al. ..... 60/202

FOREIGN PATENT DOCUMENTS

GB 0 132 065 A2 * 1/1985

* cited by examiner

*Primary Examiner*—Charles G. Freay
*Assistant Examiner*—Han L. Liu

(57) ABSTRACT

An electric thruster has at least a portion of a surface of at least one of the component elements of its housing surface treated to increase the thermal transmission at the surface. The surface treatment is selected to increase the thermal absorption and thence the absorption of heat at the interiorly facing surfaces of the treated component, and/or to increase the thermal emissivity and thence radiation heat loss at the exteriorly facing surfaces of the treated component, and/or to increase the effective surface area through which heat is absorbed or emitted. The surface-treated housing components are assembled together with a cathode assembly, an ionization chamber, a propellant gas source, and a magnetic structure to form an electric thruster.

20 Claims, 3 Drawing Sheets

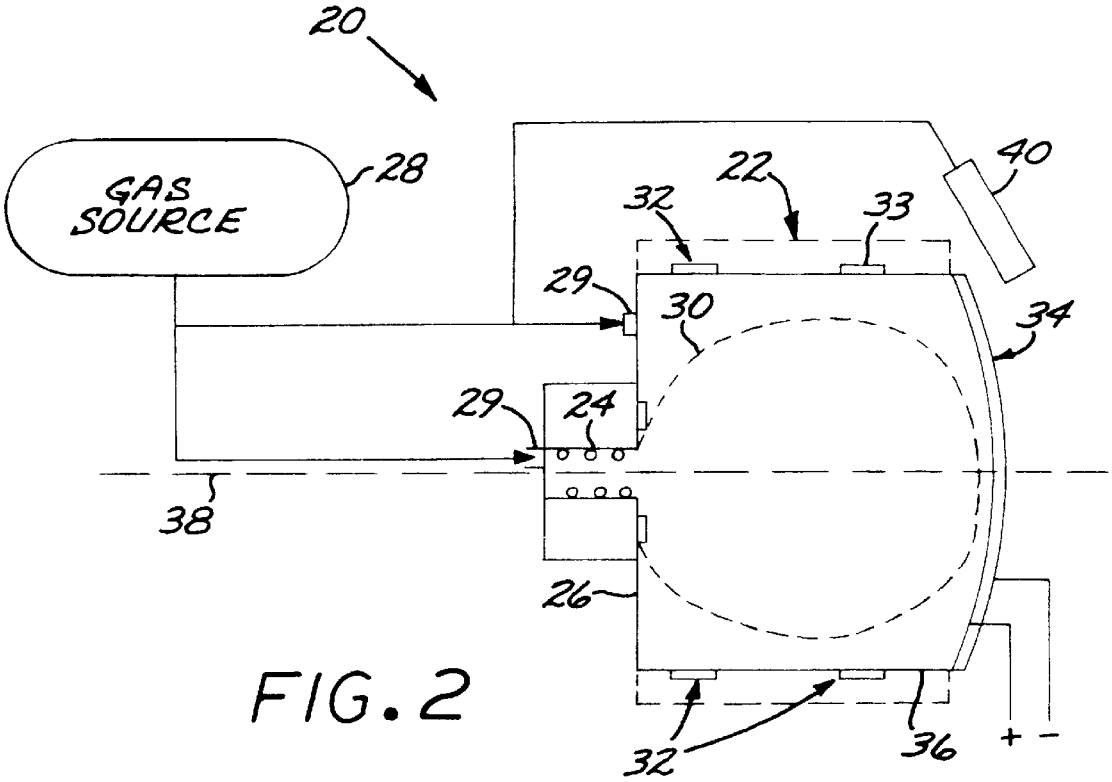
FIG. 2
FIG. 3
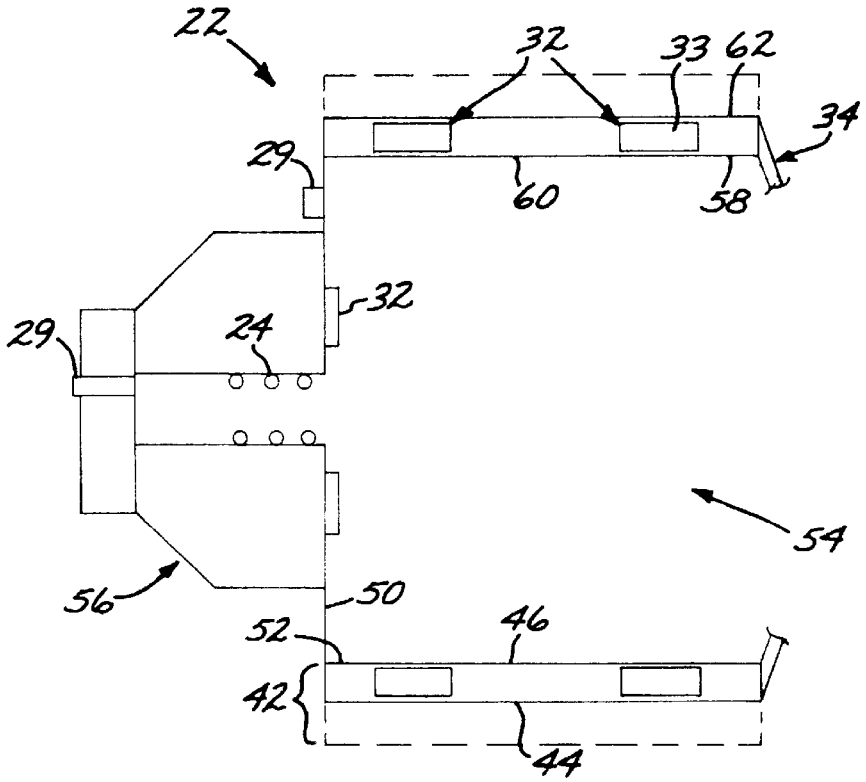

ELECTRIC THRUSTER MADE WITH SURFACE TREATMENTS FOR IMPROVED THERMAL MANAGEMENT

This invention relates to an electric thruster and, more particularly, to controlling the temperature of the components of the electric thruster.

BACKGROUND OF THE INVENTION

Electric thrusters are used in spacecraft such as communications satellites for stationkeeping and other functions. They may also be used for primary propulsion in deep-space and interplanetary missions. An important advantage of the electric thruster over an engine using chemical propellants is that it utilizes the electrical power generated by the solar cells or other power sources of the spacecraft to accomplish the propulsion. The electric thruster has a high specific impulse, making it an efficient engine which requires very little propellant. Since the electric thruster requires relatively small amounts of the consumable propellant, it is not necessary to lift large masses of propellant to orbit.

In an electric thruster, a plasma is created by electron bombardment of atoms and is maintained within the body of the thruster by a magnetic structure. Ions from the plasma are electrostatically accelerated rearwardly by an ion-optics system. The opposite reaction with the spacecraft drives it forwardly, in the opposite direction. The force produced by the electric thruster is relatively small compared with a chemical-propellant engine. The electric thruster is therefore operated for a relatively long period of time to impart the required momentum change to the heavy spacecraft. For some missions the electric thruster must be operable and reliable for thousands of hours of operation, through multiple starts and stops, and in throttling procedures where the power output of the electric thruster is adjusted as needed.

Most electric thrusters for spacecraft to date have been of relatively low power density. Current spacecraft plans contemplate much more powerful electric thrusters. Designs are needed for such higher-power electric thrusters. The present invention fulfills this need in part, and further provides related advantages.

SUMMARY OF THE INVENTION

The present invention provides an electric thruster that is suited for applications requiring increased power output and/or high-rate transient operations of the thruster. The inventors have recognized that a key limiting consideration for higher-power electric thrusters is removing the larger amount of by-product heat that is generated in the higher-power electric thruster. If the heat is not removed, the temperatures of the magnets of the magnetic structure rise above their temperature limits, so that the magnets lose their field strength and may become ineffective. Wiring and insulators may also be damaged. Excessively high temperatures may also warp the structure of the electric thruster and lead to structural failures.

Many of the structural shapes and materials of construction of the electric thruster are dictated by considerations of efficient creation of the plasma and ion extraction from it. It is also important to maintain the electric thruster as small in volume and as light in weight as possible. The ability to achieve high heat removal by reconfiguring the structural elements or by the selection of different materials of construction is therefore somewhat constrained.

The present invention utilizes a different approach. The surfaces of elements of the electric thruster are altered to increase their thermal absorptances to maximize heat absorption into these elements through their interiorly facing surfaces, and/or to increase their emissivities to maximize the radiation of heat from their exteriorly facing surfaces, and/or to increase the surface area through which heat is absorbed or emitted. The configuration of the elements and their base materials of construction are not altered. The electric thruster may be structurally optimized for performance, while at the same time achieving increased heat removal to allow the electric thruster to operate at higher power levels.

In accordance with the invention, an electric thruster comprises a housing having a wall with an opening therethrough. At least a portion of the wall of the housing has a surface treatment of a treated portion of its surface to increase a thermal transmission therethrough. The electric thruster further includes a source of a plasma within the housing, the plasma comprising electrons and ions of a propellant gas species, and an accelerator operable to extract the ions from the plasma and to accelerate the extracted ions out of the housing through the opening. The surface treatment is selected to increase the absorption of heat at the interiorly facing surfaces of the treated component, for example by increasing the thermal absorption coefficient ($\alpha$) of the interiorly facing surfaces and/or the surface area of the interiorly facing surfaces through which heat is absorbed, and/or to increase the radiation heat loss at the exteriorly facing surfaces of the treated component, for example by increasing the thermal emissivity coefficient ($\epsilon$) of the exteriorly facing surfaces and/or the surface area of the exteriorly facing surface from which heat is emitted. These surface treatments have the effect of increasing the rate of heat transmission through the wall of the housing and keeping the interior cooler and/or allowing higher power densities to be used.

In a preferred form, an electric thruster comprises a housing that includes a lateral wall having a side wall and an anode wall disposed interiorly of the side wall. Optionally, a plasma screen is part of the lateral wall and is disposed exteriorly of the side wall. The housing further includes a back wall affixed to the lateral wall at a first end thereof. The back wall and the anode wall define a discharge chamber. A support structure is affixed to the lateral wall and to the back wall. At least one of the side wall, the anode wall, the plasma screen, the back wall, and the support structure has a surface treatment of at least a portion thereof to increase a thermal transmission therethrough. The surface treatments are as described previously and as will be described in more detail below. A magnetic structure is disposed within the housing and adjacent to the discharge chamber. A cathode assembly extends into the discharge chamber through at least one of the lateral wall and the back wall, a propellant gas inlet extends into the discharge chamber through at least one of the lateral wall and the back wall, and an ion-optics accelerator is affixed to a second end of the lateral wall.

A method for manufacturing an electric thruster comprises the steps of furnishing a set of the component elements of an electric thruster housing, and surface treating at least a portion of a surface of at least one of the component elements of the housing to increase the thermal transmission thereof. The method further includes furnishing an electron source, an ionization chamber, a propellant gas source, a magnetic structure, and an accelerator, and assembling the component elements of the housing, the electron source, the ionization chamber, the propellant gas source, the magnetic structure, and the accelerator together to form the electric thruster.

Some examples of operable surface treatments include anodizing the surface, roughening the surface, and applying a high-emissivity coating to the exteriorly facing surface. Coating procedures may include, for example, chromelizing the surface, black anodizing the surface, and depositing black nickel on the surface.

The present approach has the advantage that the essential functionality, configuration, and design of the thruster housing are not changed. The materials of construction and the configuration of the components may be selected and optimized for the operation of the electric thruster. Separately, the surface thermal properties of these components are modified to improve the removal of heat from the housing of the electric thruster. The electric thruster is therefore able to operate to higher power levels and/or with greater transient heat loadings than possible in the absence of the present approach.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 2 is a schematic system depiction of a preferred form of an electric thruster;

FIG. 3 is a schematic detail view of a portion of the electric thruster of FIG. 1.

DETAILED DESCRIPTION OF THE INVENTION

Figure 1:
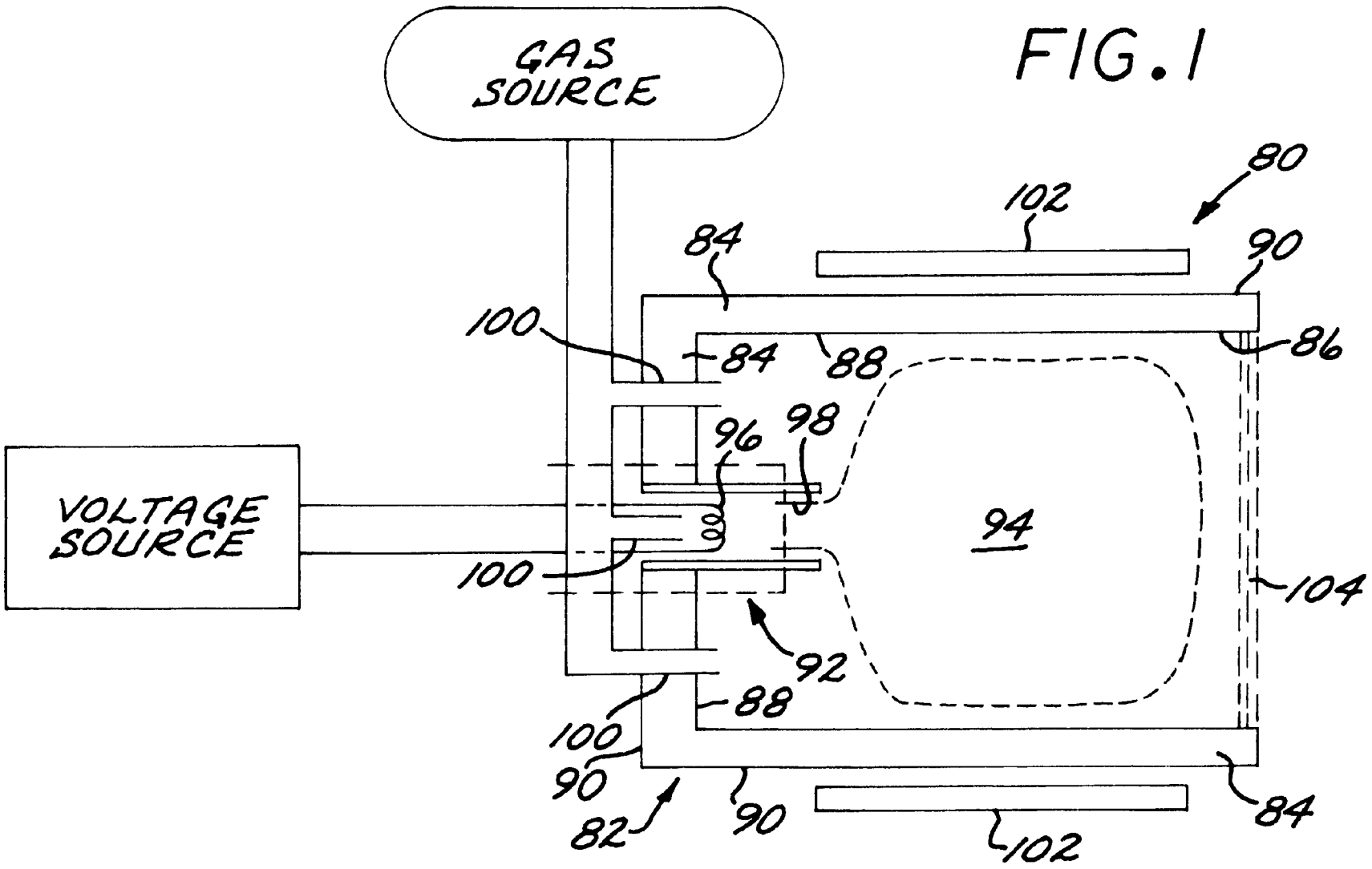
FIG. 1 is a schematic system depiction of a general form of an electric thruster.

The present invention is applicable to various types of electric thrusters (a variety of which is termed an "ion thruster"), and FIG. 1 presents an electric thruster 80 in a general form. The electric thruster 80 includes a housing 82 having a wall 84 with an opening 86 therethrough. The wall 84 has an interiorly facing surface 88 and an exteriorly facing surface 90. There is a source 92 of a plasma 94 within the housing 82. The plasma 94 comprises electrons and ions of a propellant gas species. The source 92 of the plasma 94 typically comprises an electron source 96 that produces free electrons within the housing 82, an ionization chamber 98 that excites the free electrons to produce the plasma 94, a propellant gas source 100 that introduces an ionizable propellant-gas species into the plasma 94 to produce ions within the ionization chamber 98, and a magnetic structure 102 that increases the probability that electrons will ionize the propellant gas. The electric thruster 80 further includes an accelerator 104 operable to extract the ions from the plasma 94 and to accelerate the extracted ions out of the housing 82 through the opening 86. Several different types of electric thrusters 80 have been developed based upon this general concept. These types of electric thrusters differ principally by the nature of the electron source 96, the ionization chamber 98, the magnetic structure 102, and the accelerator 104, and also by improvements and modifications made to this basic configuration. All of these electric thrusters come within the scope of the improvements of the present invention.

The inventors have observed that the various types of electric thrusters work well when they operate at low power densities. However, when the power density is increased, the heat generated by the plasma within the electric thruster cannot be readily dissipated and the efficiency of the electric thruster falls.

According to the present approach, at least a portion of the wall 84 of the housing 82 has a surface treatment of at least a treated portion of its surface to increase a thermal transmission therethrough. That is, the surface treatments produce an increased rate of absorption of heat by the interiorly facing surface 88 from the plasma 84, and an increased rate of radiation of heat by the exteriorly facing surface 90 to the external environment. Three types of surface treatments are of particular interest, although the present invention is not so limited. In one, the interiorly facing surface 88 of the housing 82 is treated to increase its thermal absorptance. In another, the exteriorly facing surface 90 of the housing 82 is treated to increase its thermal emittance. In the third, the surface area of the interiorly facing surface 88 and/or the exteriorly facing surface 90 is increased to increase the thermal transfer rate. In this third treatment, the surface treatment to increase the surface area is preferably in the nature of a roughening or grooving of the surface or the like, and is not a reconfiguring of the housing by the addition of fins or the like. The materials of construction of the wall 84 are not changed, and the configuration (e.g., shape and size) and thickness of the wall 84 are not changed, as these parameters are selected to optimize the performance of the electric thruster 80. Instead, these surface-treatment approaches are designed to increase the rate of removal of heat from the interior of the housing 82, thereby more rapidly cooling the interior of the housing 82 and keeping the wall temperature below a maximum service temperature.

FIG. 2 depicts a preferred form of an electric thruster 20, and specific forms of the surface treatments will be discussed in relation to this preferred electric thruster 20 with the understanding that they are applicable to the other forms of electric thrusters 80. The preferred type of electric thruster is known in the art, except for the improvements to be discussed herein. See, for example, U.S. Pat. No. 5,924,277, whose disclosure is incorporated by reference, and the ion thruster discussed therein. Accordingly, only the basic features of the preferred electric thruster 20 are described here for reference and for establishing the setting of the surface treatments. Other types of electric thrusters than that illustrated here are known, and the present invention is equally applicable to those other types.

The electric thruster 20 includes a housing 22 having a cathode assembly 24 at a first end 26. A propellant gas, such as xenon, from a gas source 28 is injected into the housing 22 at propellant gas inlets 29 (only some of which are shown to avoid clutter in the drawings) located at the first end 26. Electrons emitted from the cathode assembly 24 ionize the propellant gas, creating a plasma 30 within the housing 22. A magnetic structure 32, including a plurality of magnets 33, has a magnetic field extending into the interior of the housing 22 to increase the probability that the emitted electrons will ionize the propellant gas.

Ions are electrostatically extracted from the plasma 30 by an ion-optics accelerator 34 at a second end 36 of the housing 22 and accelerated out of the housing 22 (to the right in FIG. 2), generally along a thrust axis 38 as an ion beam. The housing 22 is preferably generally cylindrically symmetrical about the thrust axis 38. The ionic mass accelerated to the right in FIG. 2 drives the housing 22, and the spacecraft to which it is affixed, to the left in FIG. 2. The ionic charge and current of the ion beam are neutralized and balanced by an injection of electrons into the ion beam by an electron source 40.

FIG. 3 illustrates in greater detail those components of the electric thruster 20 that are pertinent to the further discussion of the present invention. The housing 22 of the electric thruster 20 includes a lateral wall 42 having a side wall 44 made of a sidewall material and an anode wall 46 disposed radially interiorly of the side wall 44. The anode wall 46 is made of an anode-wall material. The lateral wall 42 further optionally includes a plasma screen disposed exteriorly of the side wall 44. The plasma screen is made of a plasma-screen material and typically has a porosity (open area of the screen as a percentage of its total area) of about 60 percent. A back wall 50 is affixed to the lateral wall 42 at a first end 52 thereof. The back wall 50 is made of a back-wall material. The back wall 50 and the anode wall 46 together define a discharge chamber 54 containing the plasma 30. A support structure 56 is affixed to the back wall 50 and optionally to the lateral wall 42. The support structure 56 is made of a support-structure material. Each of the side wall 44, the anode wall 46, the plasma screen, the back wall 50, and the support structure 56 has an interiorly facing surface, indicated generally at 60, which faces inwardly toward the plasma 30, and an exteriorly facing surface, indicated generally at 62, which faces outwardly on the side away from the plasma 30.

The magnets 33 of the magnetic structure 32 are disposed within the housing 22 adjacent to the discharge chamber 54. The cathode assembly 24 extends into the discharge chamber 54 through at least one of the lateral wall 42 and the back wall 50. The propellant gas inlet 29 extends into the discharge chamber 54 through at least one of the lateral wall 42 and the back wall 50. The ion-optics accelerator 34 is fixed to the lateral wall 42 at a second end 58 thereof.

When the electric thruster 20 operates, the loss of electrons and ions from the plasma 30 generates heat. When the heat raises the temperature excessively, there is a risk of heating the magnets 33 of the magnetic structure 32 above their operating temperature limits and irreversibly degrading them. There is also a risk of melting nearby nonmetallic structures such as the insulation of the electrical wiring. An additional concern is that the overheating may cause a structural failure as a result of differential thermal strains between the various elements having different coefficients of thermal expansion.

For small electric thrusters 20 generating low power densities, the heat generated by the plasma 30 is readily dissipated by radiation from the housing 22. For electric thrusters 20 having substantially larger power densities, the size and surface area of the housing does not increase proportionately with the power density, so that radiative heat dissipation of all of the generated heat from the surfaces of the housing becomes more difficult.

To accelerate heat dissipation from the housing 22, at least a portion of at least one of the side wall 44, the anode wall 46, the plasma screen, the back wall 50, and the support structure 56 has a surface treatment to alter its thermal transmission properties. The absorption of heat at the interiorly facing surfaces 60 results from particle impact from the plasma, but there also is a radiation effect. Energy absorption by radiation at the interiorly facing surfaces 60 is a function of the product of the thermal absorption times the effective surface area, and the radiation of heat at the exteriorly facing surfaces 62 is a function of the product of the thermal emissivity times the effective surface area. The preferred surface treatment is selected to increase the thermal absorption ($\alpha$) and thence the absorption of heat at the interiorly facing surfaces 60 of the treated component (as compared with the untreated component), and/or to increase the thermal emissivity ($\epsilon$) and thence radiation heat loss at the exteriorly facing surfaces 62 of the treated component (as compared with the untreated component), and/or to increase the effective surface area through which heat is absorbed or emitted (as compared with the untreated component). The removal of heat out of the discharge chamber 54 is thereby facilitated, and the components operate at lower temperatures than would otherwise be the case in the absence of the surface treatment. The specific type of surface treatment that is selected depends upon the component being treated, its material of construction, and its utilization. The following examples of operable approaches are presented, but the present invention is not limited to the approaches of these examples.

In one instance, the side wall 44 and the back wall 50 are made of a mild steel, such as 1010 to 1018 carbon steel. The carbon steel serves as a return path for the magnetic field produced by the magnetic structure 32, and any surface treatment may not adversely affect this function. The thermal absorptance of the interiorly facing surface 60 of the mild steel is increased from about 0.2 to about 0.88 by coating the interiorly facing surface of the steel with a high-absorptance coating that does not interfere with the magnetic return function. An operable and preferred coating is black nickel. The black nickel is applied to a thickness of about 0.0003 inches by electrodeposition, a known technique for other applications.

In another approach, the exteriorly facing surface 62 of the mild steel of the side wall 44 and/or the back wall 50 may be roughened to increase the emissive area while not substantially altering the numerical value of the coefficients of absorptance or emissivity. Roughening may be achieved by any operable approach. Examples include leaving surface grooves in the machining operation, and roughening the surface by peening, grit blasting, or the like. The surface grooves or roughening must be of sufficient dimensions to impart a surface relief of the surface finish of at least about 350–500 microinches rms, in order to increase the surface area substantially.

The anode wall 46 and the plasma screen are made of a stainless steel such as Type 302 or Type 304 stainless steel. The emissivities $\epsilon$ of the exteriorly facing surfaces of these components may be increased from about 0.2 to about 0.39 by chromelizing the surfaces. Chromelizing is accomplished by firing the material in a wet hydrogen environment, a known technique for other applications.

The support structure 56 is made of a composite material of aluminum oxide particles embedded in beryllium, which is available commercially from Brush Wellman as Albamet™ material. This material has a high thermal conductivity and a light weight. The emissivity of this material may be increased from about 0.2 to about 0.494 by black anodizing its surface. The absorptance of this material may be increased from about 0.2 to about 0.8 by black anodizing its surface. Black anodizing is accomplished by known techniques such as that described in MIL-A-8625F.

Other appropriate treatments to increase the thermal transmission may be applied as well. The present invention is not limited to the preferred surface treatments discussed herein.

Figure 4:
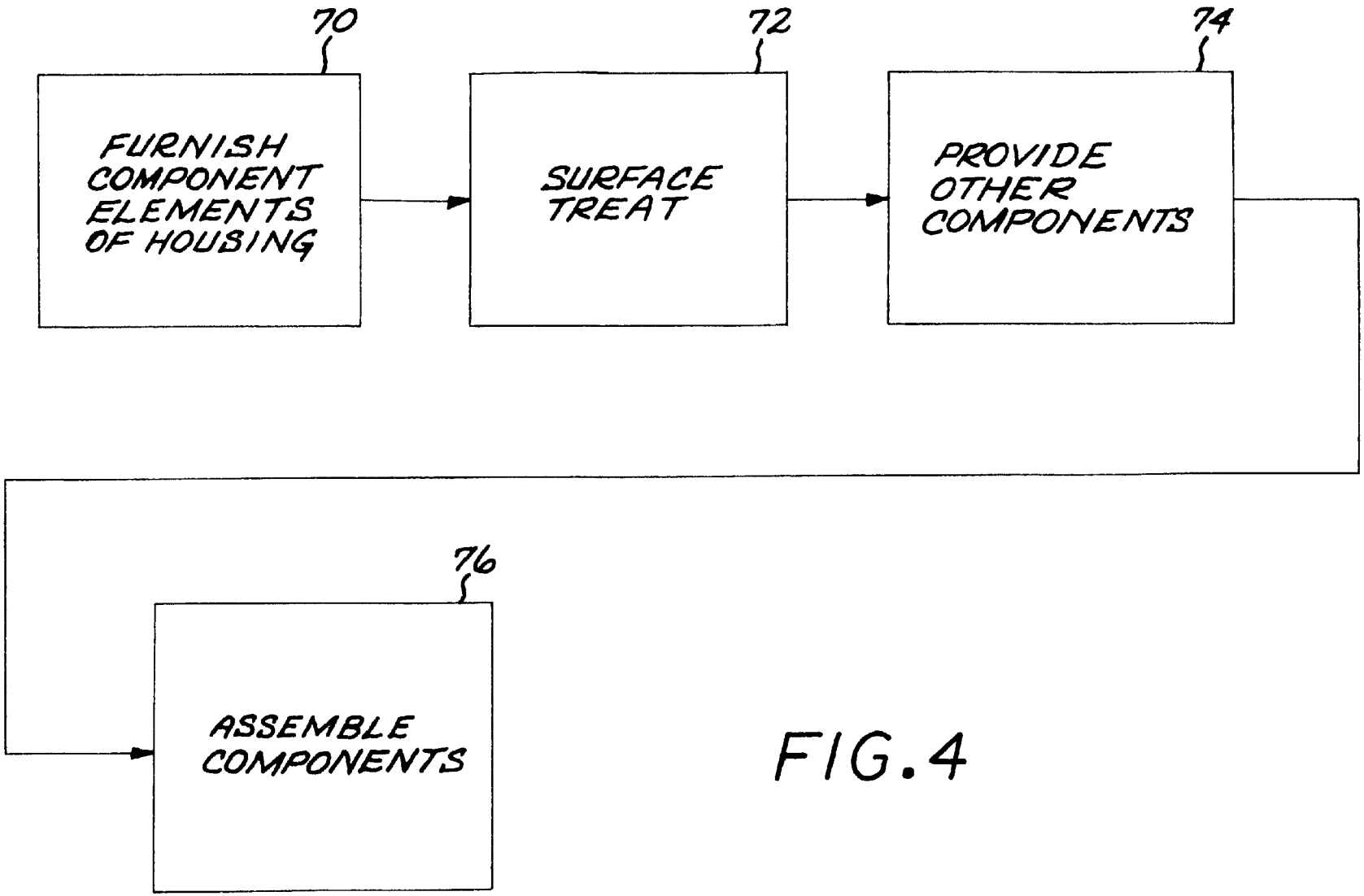
FIG. 4 is a block flow diagram of a preferred approach for practicing the invention.

FIG. 4 depicts a preferred approach for practicing the invention. The component elements of the housing 22 that are to be surface treated are furnished, numeral 70. These component elements include one or more of the side wall 44, the anode wall 46, the plasma screen (where used), the back wall 50, and the support structure 56. Improvements to the heat dissipation are accomplished with a surface treatment to any one of these component elements, but further improvements are accomplished by surface treating additional component elements.

The selected component elements are surface treated as described earlier, numeral 72. The other components which are not to be surface treated are provided, numeral 74. All of the components, those which are surface treated and those which are not surface treated, are assembled together as the electric thruster 20, numeral 76.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An electric thruster, comprising:

a housing having a wall with an opening therethrough, at least a portion of the wall of the housing having a surface treatment of at least a treated portion of its surface to increase a thermal transmission therethrough;

a source of a plasma within the housing, the plasma comprising electrons and ions of a propellant gas species; and an accelerator operable to extract the ions from the plasma and to accelerate the extracted ions out of the housing through the opening.

2. The electric thruster of claim 1, wherein the source of the plasma comprises an electron source that produces free electrons, an ionization chamber that excites the free electrons to produce the plasma, a propellant gas source that introduces an ionizable species into the plasma to produce ions within the plasma, and a magnetic structure that improves the efficiency of the ionization process within the housing.

3. The electric thruster of claim 1, wherein the surface treatment is present on an interiorly facing surface of the housing and comprises a surface treatment to increase a thermal absorptance thereof.

4. The electric thruster of claim 1, wherein the surface treatment is present on an exteriorly facing surface of the housing and comprises a surface treatment to increase a thermal emittance thereof.

5. The electric thruster of claim 1, wherein the surface treatment increases the surface area of the treated portion of the surface.

6. An electric thruster, comprising:

a housing that includes a lateral wall having a side wall, and an anode wall disposed interiorly of the side wall, a back wall affixed to the lateral wall at a first end thereof, the back wall and the anode wall defining a discharge chamber, and a support structure affixed to the lateral wall and to the back wall, at least one of the side wall, the anode wall, the back wall, and the support structure having a surface treatment of at least a treated portion thereof to increase a thermal transmission therethrough;

a magnetic structure disposed within the housing and adjacent to the discharge chamber;

a cathode assembly extending into the discharge chamber through at least one of the lateral wall and the back wall;

a propellant gas inlet extending into the discharge chamber through at least one of the lateral wall and the back wall; and an ion-optics accelerator at a second end of the lateral wall.

7. The electric thruster of claim 6 wherein the surface treatment is present on an interiorly facing surface and comprises a surface treatment to increase a thermal absorptance thereof.

8. The electric thruster of claim 6, wherein the surface treatment is present on an exteriorly facing surface and comprises a surface treatment to increase a thermal emittance thereof.

9. The electric thruster of claim 6, wherein the surface treatment increases the surface area of the treated portion of the surface.

10. The electric thruster of claim 6 wherein the side wall has an external surface and an internal surface, and wherein the external surface of the side wall has a coating thereon of black nickel.

11. The electric thruster of claim 6, wherein the side wall has an external surface and an internal surface, and wherein the external surface of the side wall is roughened.

12. The electric thruster of claim 6, wherein the anode wall has an external surface and an internal surface, and wherein the external surface of the anode wall is chromelized.

13. The electric thruster of claim 6, wherein the anode wall has an external surface and an internal surface, and wherein the external surface of the anode wall is roughened.

14. The electric thruster of claim 6 wherein the support structure has an externally facing surface, and wherein the externally facing surface is black anodized.

15. The electric thruster of claim 6, wherein the lateral wall of the housing further includes a plasma screen disposed exteriorly of the side wall, the plasma screen having a surface treatment of at least a treated portion thereof to increase a thermal transmission therethrough.

16. The electric thruster of claim 15 wherein the plasma-screen is chromelized.

17. A method for manufacturing an electric thruster, comprising the steps of furnishing a set of the component elements of an electric thruster housing;

surface treating at least a portion of a surface of at least one of the component elements of the housing to increase the thermal transmission thereof, wherein the surface treating is selected from the group consisting of surface treating an interiorly facing surface of the housing to increase a thermal absorptance thereof, surface treating an exteriorly facing surface of the housing to increase a thermal emittance thereof; and surface treating to increase a surface area of a treated portion of the surface;

furnishing an electron source, an ionization chamber, a propellant gas source, a magnetic structure, and an accelerator; and assembling the component elements of the housing, the electron source, the ionization chamber, the propellant gas source, the magnetic structure, and the accelerator together to form the electric thruster.

18. The method of claim 17, wherein the step of surface treating is performed on an interiorly facing surface and comprises a surface treatment to increase a thermal absorptance thereof.

19. The method of claim 17, wherein the step of surface treating is performed on an exteriorly facing surface and comprises a surface treatment to increase a thermal emittance thereof.

20. The method of claim 17, wherein the step of surface treating increases the surface area of the treated portion of the surface.

* * * * *